US006717338B2

(12) United States Patent
Williamson et al.

(10) Patent No.: US 6,717,338 B2
(45) Date of Patent: Apr. 6, 2004

(54) FRAME MOUNT FOR HIGH INTENSITY DISCHARGE LAMP

(75) Inventors: Glen P. Williamson, Manchester, NH (US); Ebon L. McCullough, New Ipswich, NH (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 10/097,494

(22) Filed: Mar. 13, 2002

(65) Prior Publication Data

US 2003/0173898 A1 Sep. 18, 2003

(51) Int. Cl.[7] ..... H01J 5/48; H01J 5/50

(52) U.S. Cl. ..... 313/50; 313/25; 313/317; 313/318.02; 313/318.05; 313/318.03; 313/240

(58) Field of Search ..... 313/17, 25, 49, 313/50, 634, 240, 318.02, 318.03, 318.04, 567, 573, 574, 623

(56) References Cited

U.S. PATENT DOCUMENTS 2,749,461 A * 6/1956 Hierholzer, Jr. et al. ..... 313/25
2,749,462 A * 6/1956 Kenty et al. ..... 313/25
3,094,640 A * 6/1963 Gustin ..... 313/25
4,229,678 A * 10/1980 Petro ..... 315/73
5,001,384 A * 3/1991 Bens et al. ..... 313/25
5,406,165 A * 4/1995 Pragt ..... 313/25
5,493,167 A * 2/1996 Mikol et al. ..... 313/25
5,550,422 A * 8/1996 Sulcs et al. ..... 313/25
6,326,721 B1 * 12/2001 Shippee et al. ..... 313/283

* cited by examiner

*Primary Examiner*—Ashok Patel
*Assistant Examiner*—German Colón
(74) *Attorney, Agent, or Firm*—William E. Meyer

(57) ABSTRACT

A high intensity discharge lamp (10) has an outer envelope (12) having a cup-shaped top (14), a hollow center section (16) and a bottom (18) all aligned along a longitudinal axis (20), the bottom (18) including a flare (22) having a pinch seal (24) with in-leads (26, 28) sealed therein. A mount structure (30) is positioned within the envelope, the mount structure including a frame (32) comprising a spaced-apart pair of side frames (34, 36) extending substantially the length of the envelope (12) and parallel to the longitudinal axis. The side frames (34,36) have middle portions (35,37) carrying an arc tube (38) and a surrounding shield (40), and the side frames further have an upper portion that frictionally engages the inside surface of the cup-shaped top (14), the upper portion comprising two ends (42, 44) extending in a direction normal to the longitudinal axis and having a space (50) therebetween.

5 Claims, 1 Drawing Sheet

FRAME MOUNT FOR HIGH INTENSITY DISCHARGE LAMP

TECHNICAL FIELD

This invention relates to lamps aid more particularly to high intensity discharge lamps. Still more particularly, it relates to a frame assembly for supporting a mount structure within a lamp envelope.

BACKGROUND ART

High intensity discharge lamps are known and are well used because of their high light output and favorable energy demands. Such lamps employ as a light source an arc tube of quartz or similar heat resistant material in which an arc is generated to form a heated plasma which provides the illumination. Often, these arc tubes are surround by a shroud or shield to contain shards in the unlikely event of an arc tube catastrophic failure. As light sources, these arc tube and shield assemblies are very heavy when compared to the almost insignificant weight of, for example, the tungsten filament of an incandescent lamp. Accordingly, it is the generally accepted procedure in the lamp industry to mount the arc tube assembly such that it is held in place by structures at both the top and bottom of the lamp envelope. The bottom mounting arrangements are generally easier to handle because of the flare and pinch seal available at the bottom of the lamp, as well as the availability of the relatively substantial in-leads. Securing the mount structure to the top of the lamp envelope has proven to be more of a problem, caused primarily by the rather large tolerances permitted in many lamp envelopes. Techniques have included multiple springs as shown in U.S. Pat. No. 5,065,069, a dimple and rig arrangement, shown in U.S. Pat. Nos. 5,327,042 and 4,963,790, and snubbers, such as shown in U.S. Pat. No. 4,801,846. While all of the above-cited techniques have been employed, problems persist because of excess cost (the multiple spring arrangement), problems with envelope breakage (the dimple and ring) and costs involved in manually adjusting the snubbers to accommodate the differing envelope sizes caused by the rather large tolerances permitted, the latter technique often requiring a mount to be inserted and withdrawn multiple times before the correct tension is achieved.

DISCLOSURE OF INVENTION

It is, therefore, an object of this invention to obviate the disadvantages of the prior art.

It is another object of the invention to provide a stable arc tube mount that will accommodate differing diameters occurring in lamp envelopes.

These objects are accomplished, in one aspect of the invention by the provision of a high intensity discharge lamp comprising: an outer envelope having a cup-shaped top, a hollow center section and a bottom all aligned along a longitudinal axis, the bottom including a flare having a pinch seal with in-leads sealed therein; and a mount structure within the envelope, the mount structure including a frame comprising a spaced-apart pair of side frames extending substantially the length of the envelope and parallel to the longitudinal axis, the side frames having middle portions carrying an arc tube and a surrounding shield, the side frames further comprising an upper portion that frictionally engages the inside surface of the cup-shaped top, the upper portion comprising two ends extending in a direction normal to the longitudinal axis and having a space therebetween.

The two ends extending toward one another provide a spring-effect that holds the mount in position. Further, the amount of movement capable between the two ends accommodates the great variation that can occur in the inside diameter of the upper portion of the lamp envelope.

BRIEF DESCRIPTION OF THE DRAWINGS

The single FIGURE illustrates an embodiment of the invention.

BEST MODE FOR CARRYING OUT THE INVENTION

Figure 1:
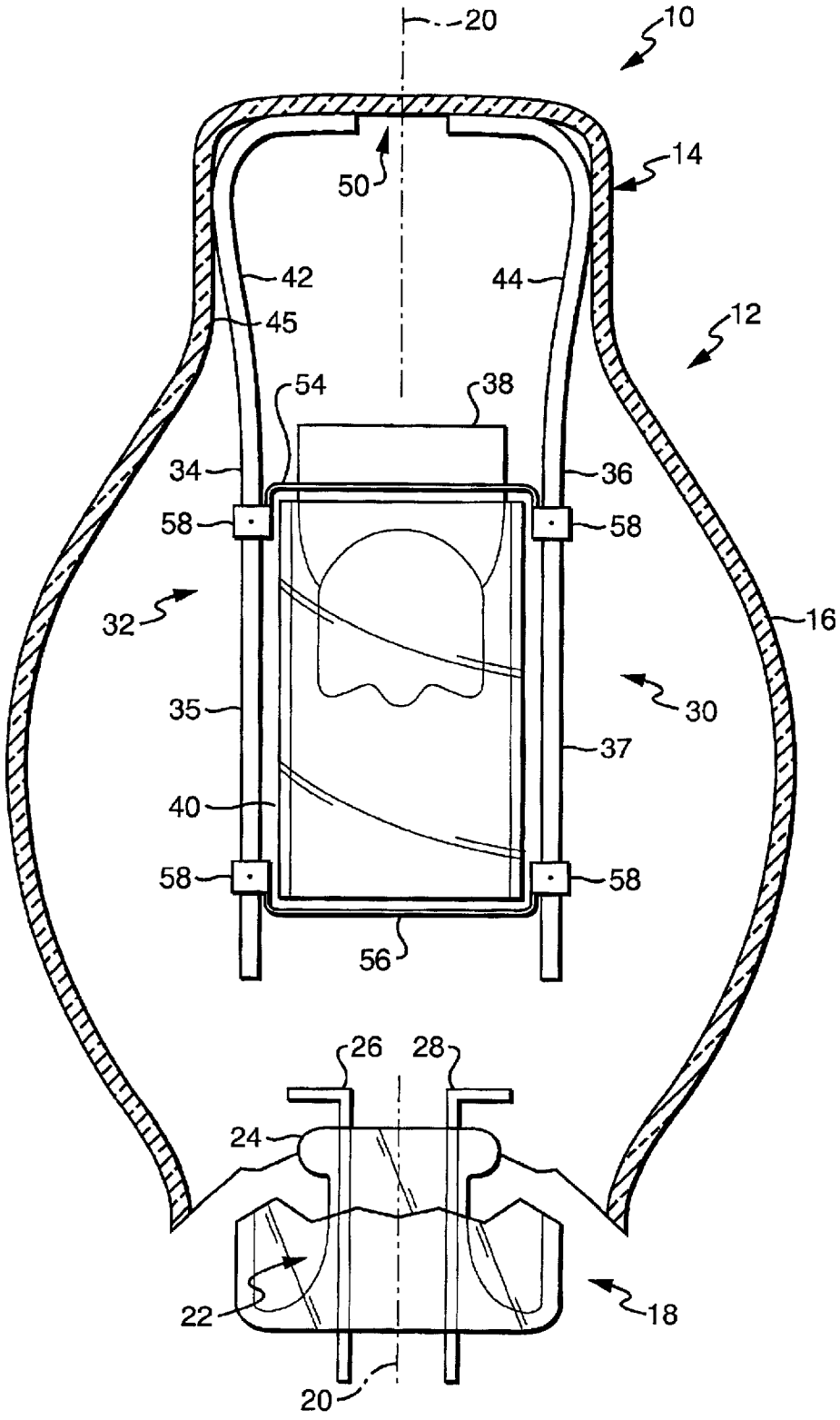

For a better understanding of the present invention, together with other and further objects, advantages and capabilities thereof, reference is made to the following disclosure and appended claims in conjunction with the above-described drawings.

Referring now to the drawings with greater particularity, there is shown in the figure a high intensity discharge lamp 10 that comprises an outer envelope 12 having a cup-shaped top 14. The bulb 12 has a hollow center section 16 that can be bulbous and a bottom 18 all aligned along a longitudinal axis 20. The bottom includes a flare 22 having a pinch seal 24 with in-leads 26 and 28 sealed therein. A mount structure 30 is positioned within envelope 12. The mount structure 30 includes a frame 32 comprising a spaced-apart pair of side frames 34, 36 extending substantially the length of the envelope 12 and parallel to the longitudinal axis 20. The side frames 34, 36 have middle portions 35, 37 carrying an arc tube 38 and a surrounding shield 40. The side frames 34, 36 further comprise upper portions 42, 44 that frictionally engage the inside surface 45 of the cup-shaped top 14. The upper portions 42, 44 each comprise an end extending in a direction normal to the longitudinal axis 20 and have a space 50 therebetween. The ends of the upper portions opposite the space 50 are provided with a radius to allow smooth insertion into the lamp.

The side frames 34, 36 are constructed of a tensionable wire material, such as spring temper stainless steel and having a diameter of 0.080 inches.

In a preferred embodiment of the invention the mount structure 30, as noted above, includes a shroud or shield 40 that surrounds the arc tube 38. The shroud 40 is held in place such that it cannot move axially or radially by annular ring clips 54, 56, located at opposite ends of the shroud, as is known in the art. The ring clips 54, 56 are provided with tabs 58 to which the side frames 34, 36 are attached, as by welding. The arc tube 38 is suspended within the shroud 52 by any suitable means.

The side frames 34, 36 are preferably formed as two separate pieces; however, the frame can be formed as a single piece with the space 50 provided by cutting away a section of the frame before assembly into the lamp envelope.

This frame provides ease of assembly into the lamp envelope and accommodates the wide variations that can occur in the inside diameter of the cup-shaped top portion of the envelope, which can have tolerances of ±0.085 inches on the inside diameter.

While there have been shown and described what are at present considered to be the preferred embodiments of the invention, it will be apparent to those skilled in the art that various changes and modification can be made herein without departing from the scope of the invention as defined by the appended claims.

What is claimed is:

1. A high intensity discharge lamp comprising:

an outer envelope having a cup-shaped top, a hollow center section and a bottom all aligned along a longitudinal axis, said bottom including a flare having a pinch seal with in-leads sealed therein;

and a mount structure within said envelope, said mount structure including a frame comprising a spaced-apart pair of wire side frames extending substantially the length of said envelope and parallel to said longitudinal axis, said wire side frames having middle portions carrying an arc tube and a surrounding shield, said wire side frames further comprising an upper portion that is snubber-free and consists solely of said wire that frictionally engages the inside surface of said cup-shaped top, said upper portion comprising two wire ends extending in a direction normal to said longitudinal axis and having a space therebetween.

2. The lamp of claim 1 wherein said hollow center section is bulbous.

3. A frame for a high intensity discharge lamp, said frame comprising:

two spaced apart, wire members, said wire members each having a top portion that is snubber-free and consists solely of said wire formed to frictionally engage a top of said lamp and having a space therebetween; and a middle portion formed to support an arc tube and a shield.

4. The frame of claim 3 wherein said spaced apart wire frame members are constructed of spring temper stainless steel.

5. The lamp of claim 4 wherein said frame members have a diameter of 0.080 inches.

* * * * *